US009463349B1

(12) United States Patent
Chang

(10) Patent No.: US 9,463,349 B1
(45) **Date of Patent: *Oct. 11, 2016**

(54) TREADMILL WITH MULTIPLE SHOCK-ABSORBING FUNCTIONS

(71) Applicant: Li-Ling Chang, Taichung (TW)

(72) Inventor: Li-Ling Chang, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/666,377

(22) Filed: Mar. 24, 2015

(51) Int. Cl.
*A63B 22/02* (2006.01)

(52) U.S. Cl.
CPC ..... *A63B 22/02* (2013.01); *A63B 2022/0214* (2013.01)

(58) Field of Classification Search
CPC ..... A63B 22/02–22/0292
See application file for complete search history.

(56) References Cited

U.S. PATENT DOCUMENTS

| | | | | |
|---|---|---|---|---|
| 5,336,144 | A * | 8/1994 | Rodden | A63B 22/02 482/51 |
| 6,013,011 | A * | 1/2000 | Moore | A63B 22/02 482/51 |
| 2003/0040405 | A1* | 2/2003 | Watterson | A63B 22/02 482/51 |

* cited by examiner

*Primary Examiner* — Oren Ginsberg
*Assistant Examiner* — Jennifer M Deichl
(74) *Attorney, Agent, or Firm* — Alan D. Kamrath; Kamrath IP Lawfrim, P.A.

(57) ABSTRACT

A treadmill includes a two side frames, a support plate disposed above the side frames, two shock-absorbing structures mounted between the support plate and the side frames, a styrofoam layer mounted on the support plate, and a surface layer mounted on the styrofoam layer. Each of the shock-absorbing structures includes an elastic bar mounted between the support plate and one of the side frames, and a plurality of vibration absorbers mounted between the support plate and one of the side frames. Thus, the elastic bar, the vibration absorbers and the styrofoam layer provide multiple shock-absorbing and vibration damping functions to the support plate.

9 Claims, 14 Drawing Sheets

TREADMILL WITH MULTIPLE SHOCK-ABSORBING FUNCTIONS

BACKGROUND OF THE INVENTION

1. Field of the Invention

The present invention relates to a treadmill and, more particularly, to a treadmill with multiple shock-absorbing functions.

2. Description of the Related Art

A conventional treadmill comprises a frame, a support plate mounted on and located above the frame, a belt mounted around the support plate, and a plurality of vibration absorbers mounted between the frame and the support plate. Each of the vibration absorbers has a cylindrical shape. In operation, when a user steps on the belt, the support plate is subjected to a downward force. At this time, the vibration absorbers apply a reaction to the support plate so as to provide a shock-absorbing function to the support plate. However, each of the vibration absorbers has a fixed elasticity that cannot be adjusted according to the user's requirement. In addition, the vibration absorbers are easily deflected and distorted due to an unevenly distributed force applied by the user's downward pressure so that the vibration absorbers are easily worn or torn during a long-term utilization, thereby decreasing the shock-absorbing function.

BRIEF SUMMARY OF THE INVENTION

In accordance with the present invention, there is provided a treadmill comprising two side frames, a support plate disposed above the side frames, two shock-absorbing structures mounted between the support plate and the side frames, a styrofoam layer mounted on the support plate, and a surface layer mounted on the styrofoam layer. Each of the shock-absorbing structures includes an elastic bar mounted between the support plate and one of the side frames. The elastic bar is movable in a transverse direction and is elastically bendable toward two opposite sides of one of the side frames.

Each of the shock-absorbing structures further includes a plurality of vibration absorbers mounted between the support plate and one of the side frames. Each of the vibration absorbers is a hollow block and has a top and a bottom. Each of the vibration absorbers has a side wall whose cross-sectional thickness is gradually increased from the top to the bottom of each of the vibration absorbers and whose peripheral width is gradually increased from the top to the bottom of each of the vibration absorbers.

According to the primary advantage of the present invention, the elastic bar, the vibration absorbers and the styrofoam layer provide multiple shock-absorbing and vibration damping functions to the support plate so that the treadmill provides a comfortable sensation to the user.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
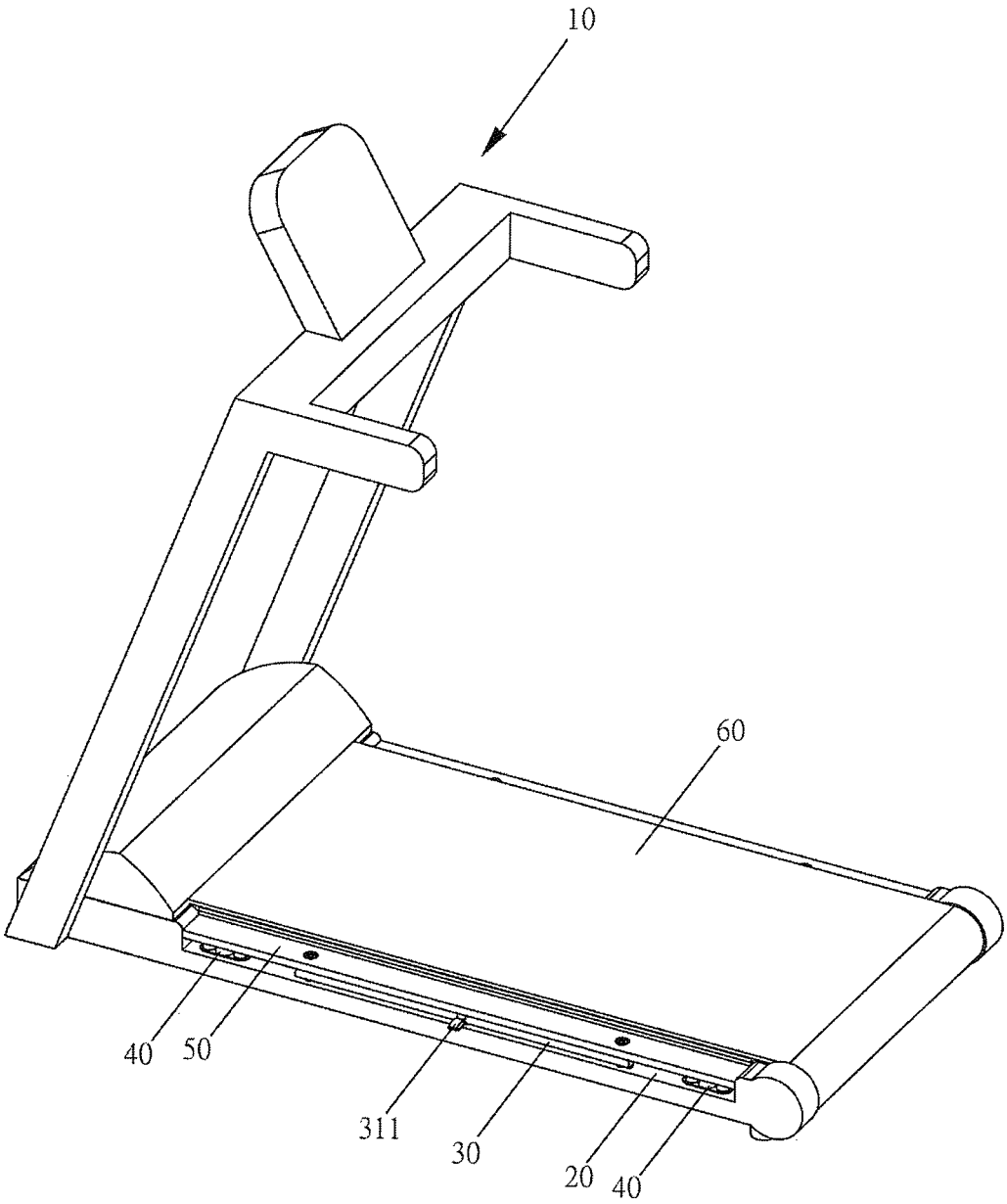
FIG. 1 is a perspective view of a treadmill in accordance with the preferred embodiment of the present invention.

Referring to the drawings and initially to FIGS. 1-8, a treadmill 10 in accordance with the preferred embodiment of the present invention comprises two side frames 20, a support plate 50 disposed above the side frames 20, two shock-absorbing structures mounted between the support plate 50 and the side frames 20, a styrofoam layer 51 mounted on the support plate 50, a surface layer 52 mounted on the styrofoam layer 51, and a belt 60 wound around the support plate 50. The styrofoam layer 51 is located between the support plate 50 and the surface layer 52. The surface layer 52 is preferably made of PVC material. The surface layer 52 contacts and rubs the belt 60.

Each of the shock-absorbing structures includes an elastic bar 30 mounted between the support plate 50 and one of the side frames 20 to support the support plate 50 and to provide a shock-absorbing function, a mounting ring 31 mounted on the elastic bar 30, and two fixing sleeves 32 mounted in the elastic bar 30. The elastic bar 30 is located above one of the side frames 20 and under the support plate 50 and has two opposite ends each pivotally mounted between the support plate 50 and one of the side frames 20. Preferably, the elastic bar 30 is a hollow tube and is arranged on a mediate section of one of the side frames 20. Thus, the elastic bar 30 is movable in a transverse direction and is elastically bendable toward two opposite sides of one of the side frames 20 to increase or decrease a contact area of the elastic bar 30 and the support plate 50 and to change a position of the elastic bar 30 relative to the support plate 50 so as to adjust a shock-absorbing effect of the elastic bar 30 to the support plate 50. In the preferred embodiment of the present invention, the elastic bar 30 is made of rubber, silicon gel or polyurethane (PU). The mounting ring 31 is mounted on a mediate portion of the elastic bar 30 and is located between the fixing sleeves 32. The mounting ring 31 is provided with two pull tabs 311. The pull tabs 311 are located at two opposite sides of the mounting ring 31 and are directed toward two opposite directions. The fixing sleeves 32 are respectively mounted in the two opposite ends of the elastic bar 30 and are pivotally mounted on one of the side frames 20.

In the preferred embodiment of the present invention, the support plate 50 has two opposite sides each provided with two first through holes 501, each of the two opposite ends of the elastic bar 30 is provided with a second through hole 301, each of the fixing sleeves 32 is provided with a third through hole 321, each of the side frames 20 is provided with two fourth through holes 201, and each of the shock-absorbing structures further includes two pivot members 70 each extending through the respective first through hole 501 of the support plate 50, the respective second through hole 301 of the elastic bar 30, the third through hole 321 of the respective fixing sleeve 32 and the respective fourth through hole 201 of one of the side frames 20, so that each of the two opposite ends of the elastic bar 30 is pivotally mounted between the support plate 50 and one of the side frames 20. The elastic bars 30 of the shock-absorbing structures support the two opposite sides of the support plate 50.

Figure 2:
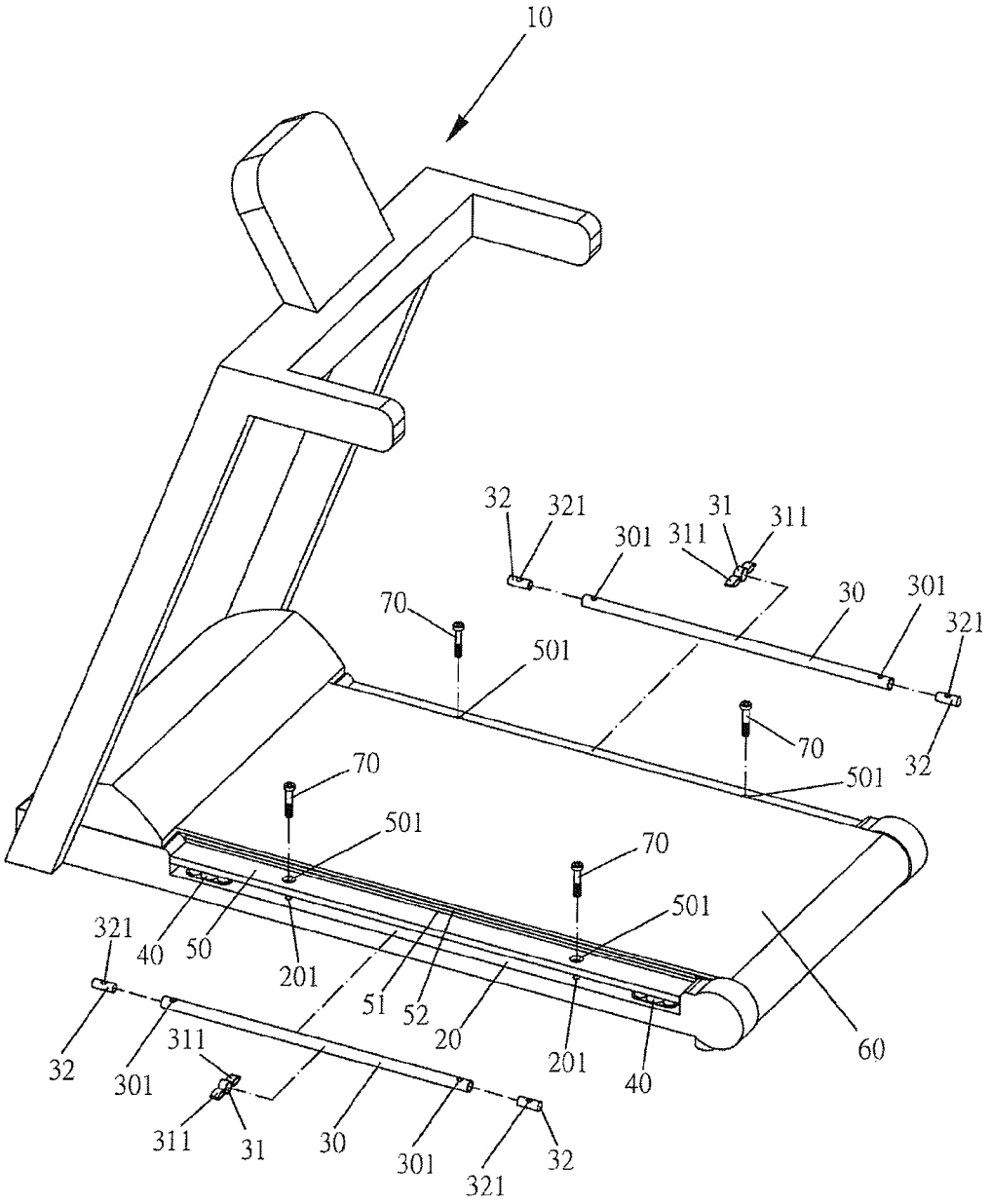
FIG. 2 is a partially exploded perspective view of the treadmill as shown in FIG. 1.
Figure 3:
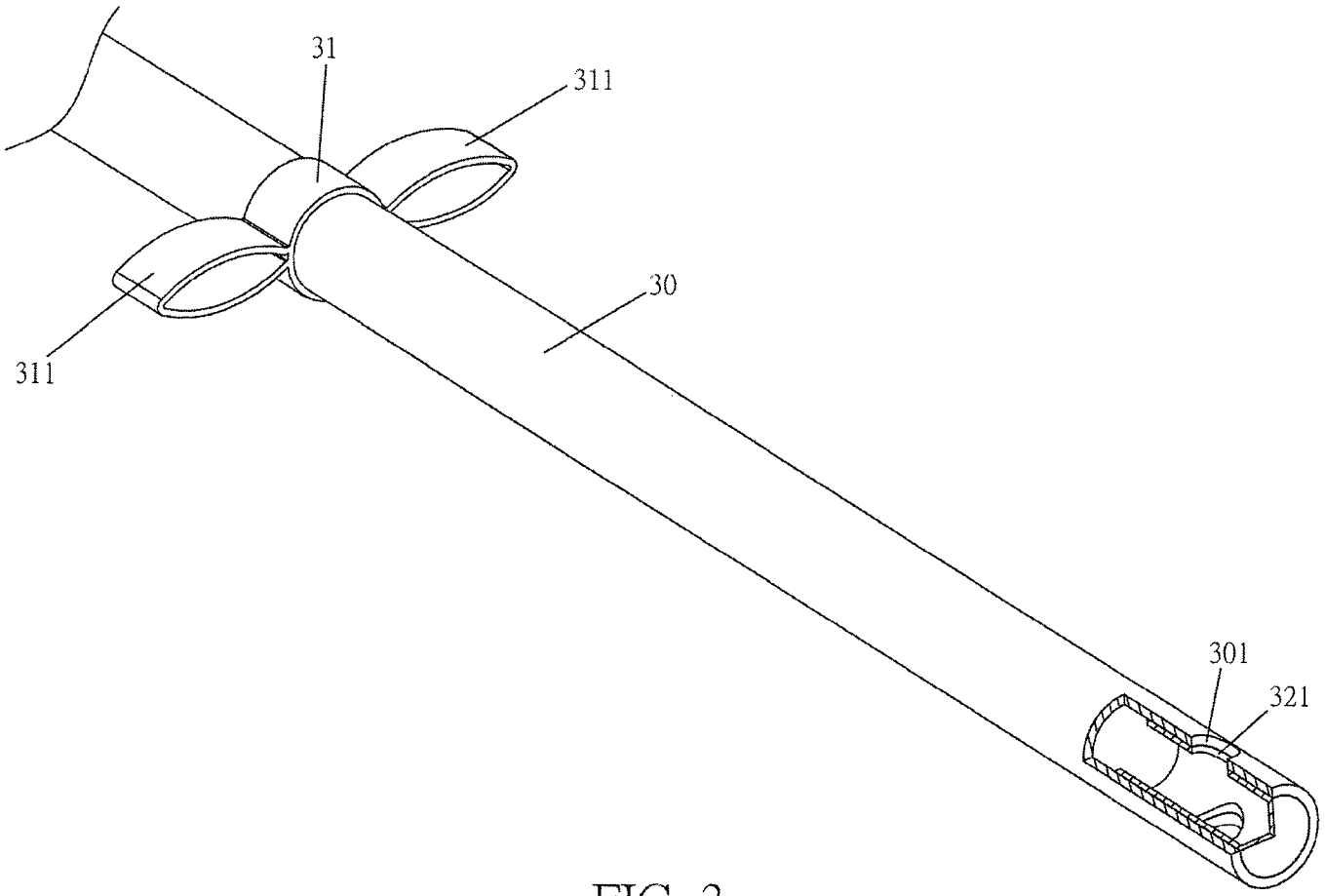
FIG. 3 is a locally enlarged perspective cross-sectional view of an elastic bar of the treadmill as shown in FIG. 1.
Figure 4:
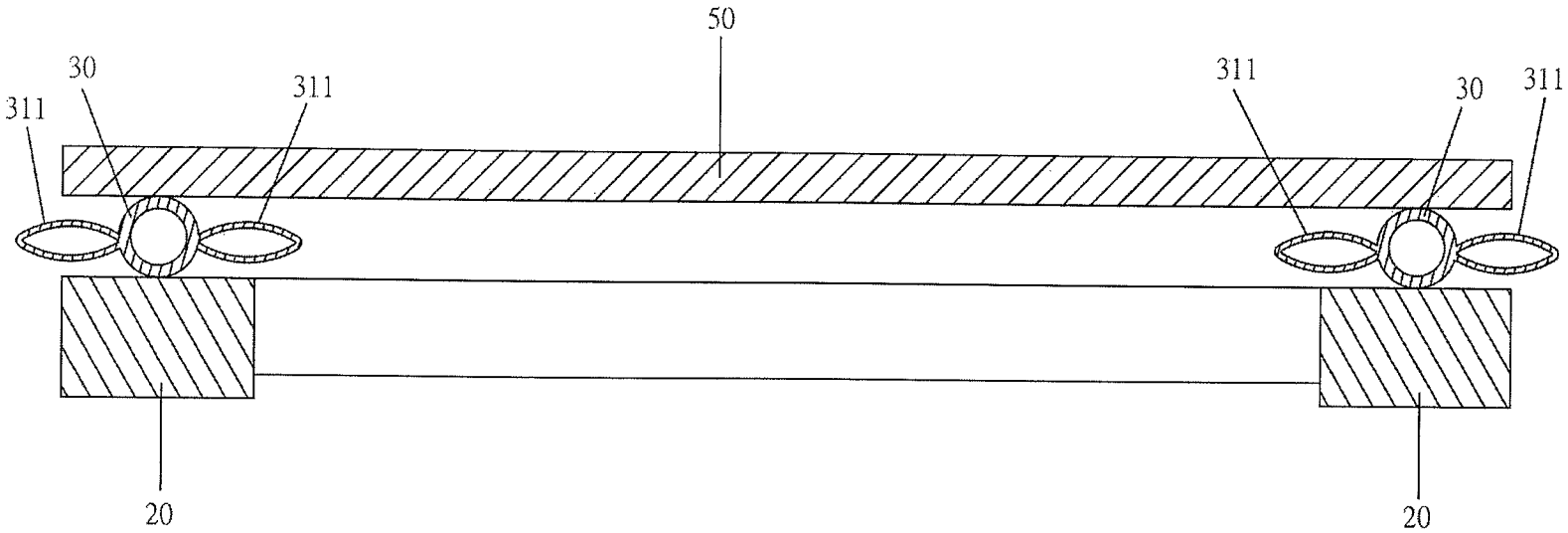
FIG. 4 is a cross-sectional view of the treadmill as shown in FIG. 4.
Figure 5:
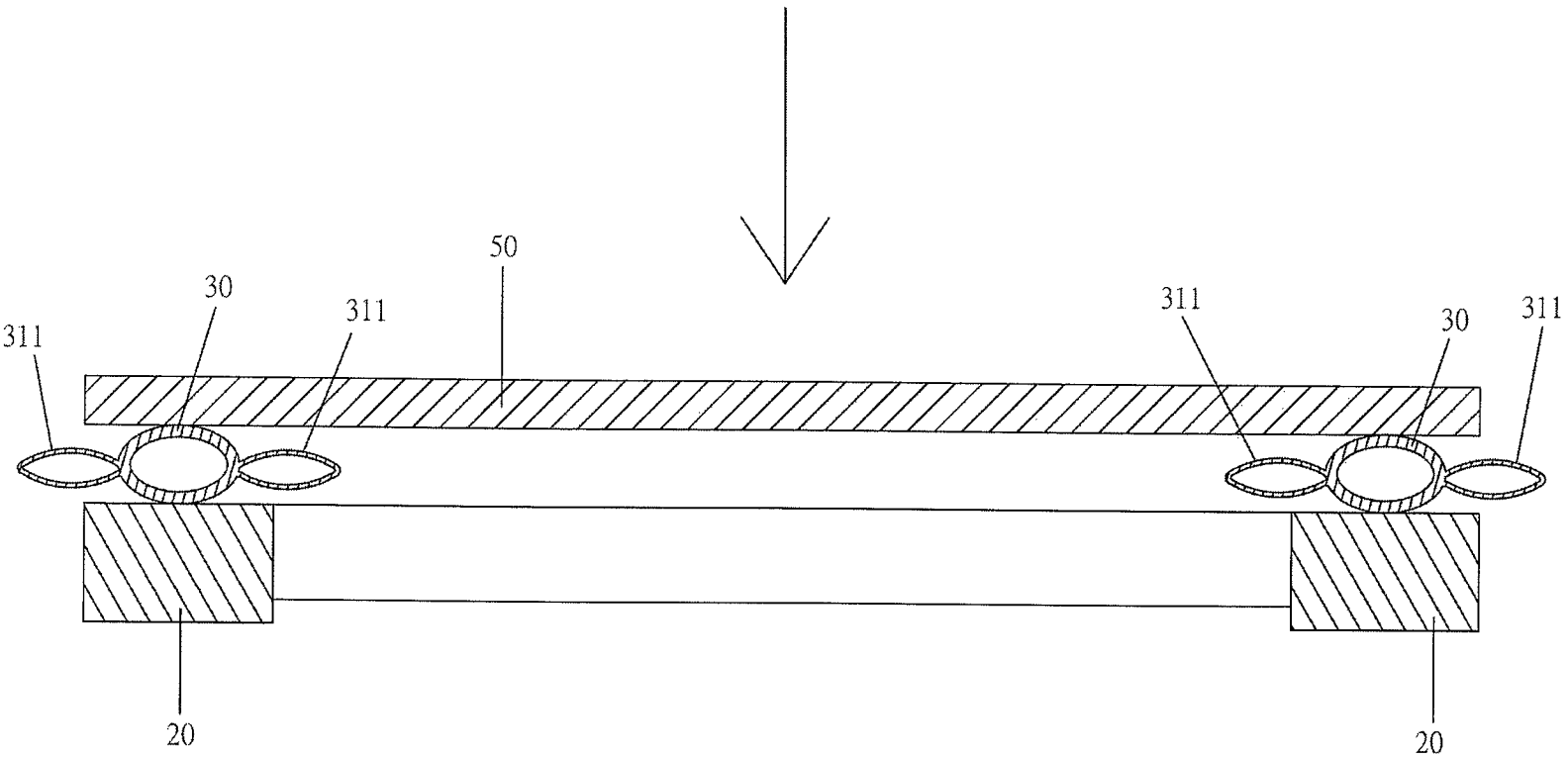
FIG. 5 is a schematic operational view of the treadmill as shown in FIG. 4 in use.

In operation, referring to FIGS. 4-8 with reference to FIGS. 1-3, when a user steps on the belt 60 of the treadmill 10, the support plate 50 is subjected to a downward force as shown in FIG. 5. At this time, the elastic bar 30 of each of the shock-absorbing structures is located under the support plate 50 to apply a reaction to the support plate 50 so as to provide a shock-absorbing function to the support plate 50.

Figure 6:
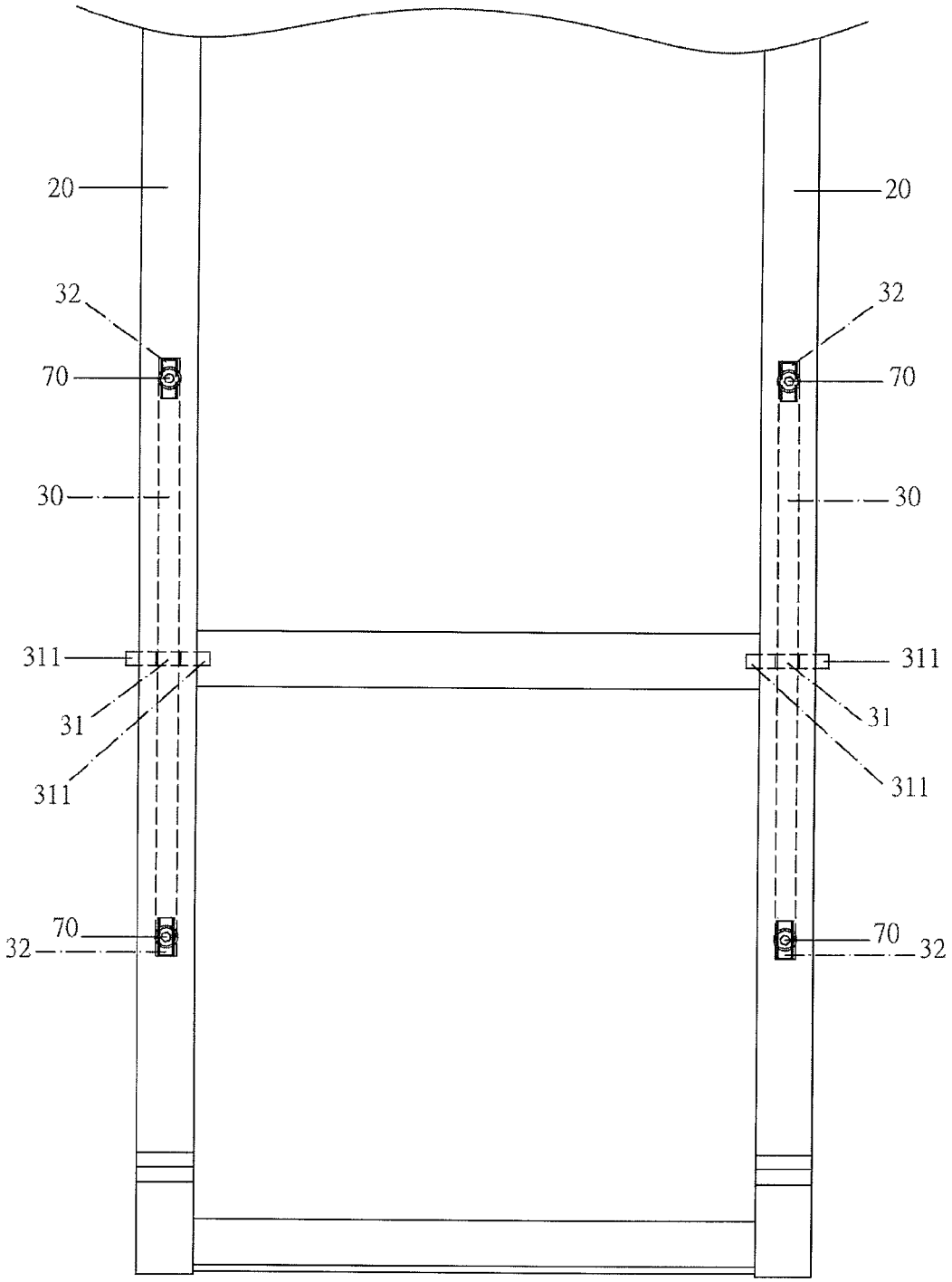
FIG. 6 is a partially top view of the treadmill as shown in FIG. 1.
Figure 7:
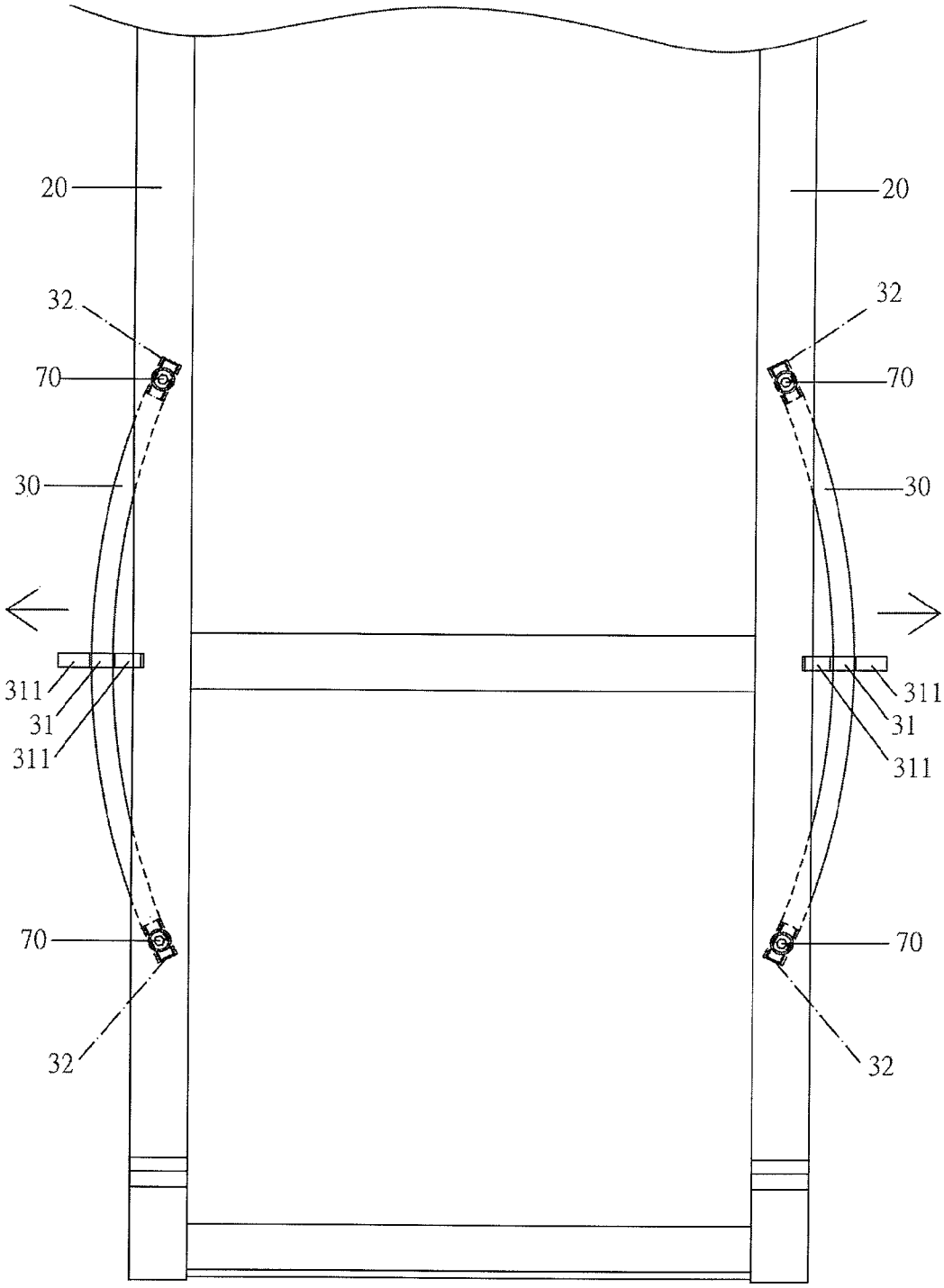
FIG. 7 is a schematic operational view of the treadmill as shown in FIG. 6 in adjustment.

In adjustment, when one of the two pull tabs 311 at the outer side of the mounting ring 31 is pulled, the elastic bar 30 of each of the shock-absorbing structures is pulled toward the outer side of one of the side frames 20 to decrease the contact area of the elastic bar 30 and the support plate 50 and to move the elastic bar 30 from the position as shown in FIG. 6 to the position at the outer side of the support plate 50 as shown in FIG. 7. At this time, the elastic bar 30 of each of the shock-absorbing structures is slightly exposed outward from the outer side of one of the side frames 20. In such a manner, when the elastic bar 30 of each of the shock-absorbing structures is pulled toward the outer side of one of the side frames 20, the contact area of the elastic bar 30 and the support plate 50 is decreased, so that the elastic bar 30 of each of the shock-absorbing structures provides a smaller buffering force to the support plate 50 and is available for a user having a lighter weight. In addition, when the elastic bar 30 of each of the shock-absorbing structures is pulled toward the outer side of one of the side frames 20, the elastic bar 30 is located at the outer side of the support plate 50, so that the elastic bar 30 of each of the shock-absorbing structures applies a smaller reaction to the support plate 50, and the central portion of the support plate 50 is disposed at a softer state due to the decreased reaction of the elastic bar 30.

Figure 8:
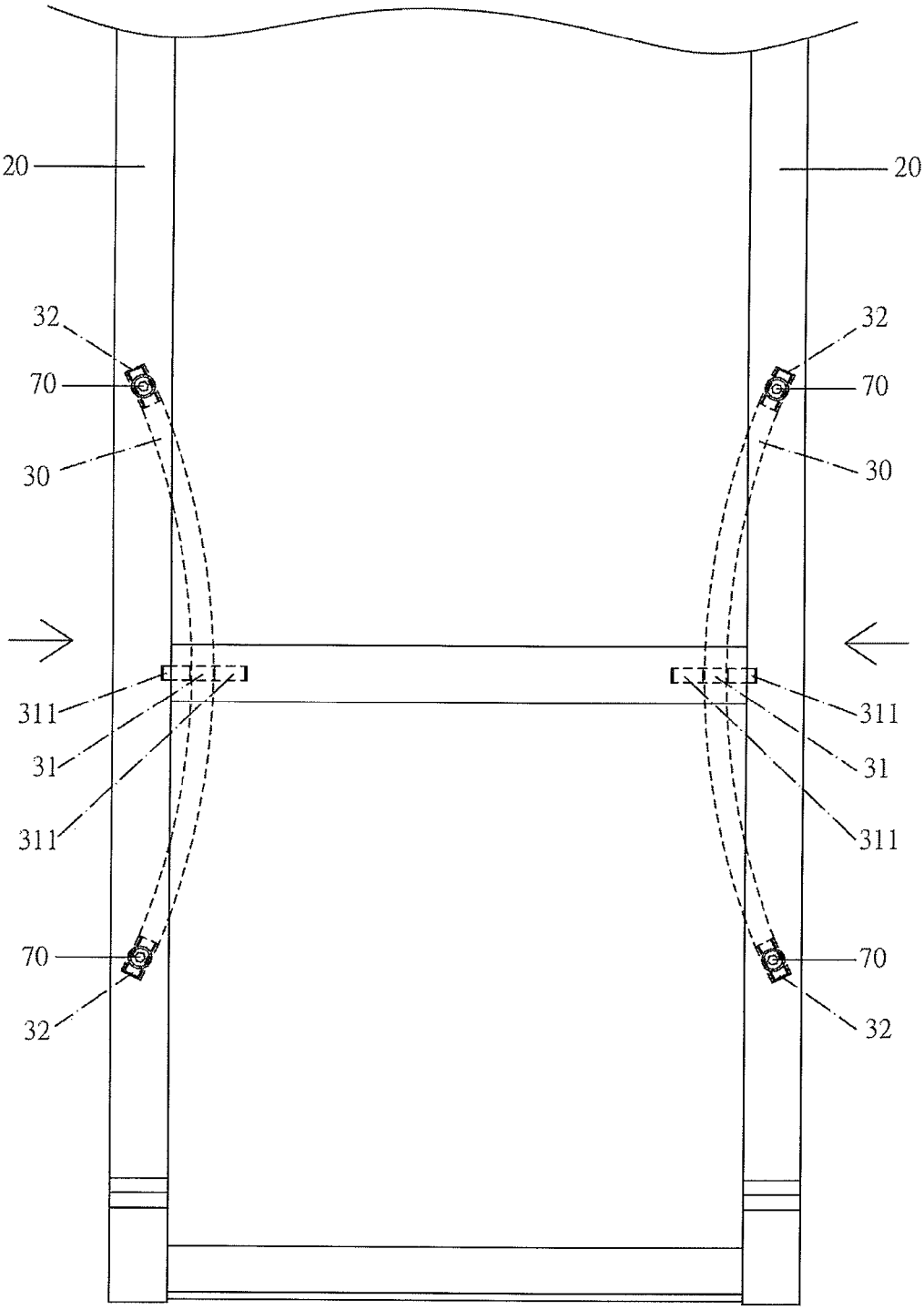
FIG. 8 is another schematic operational view of the treadmill as shown in FIG. 6 in adjustment.
Figure 9:
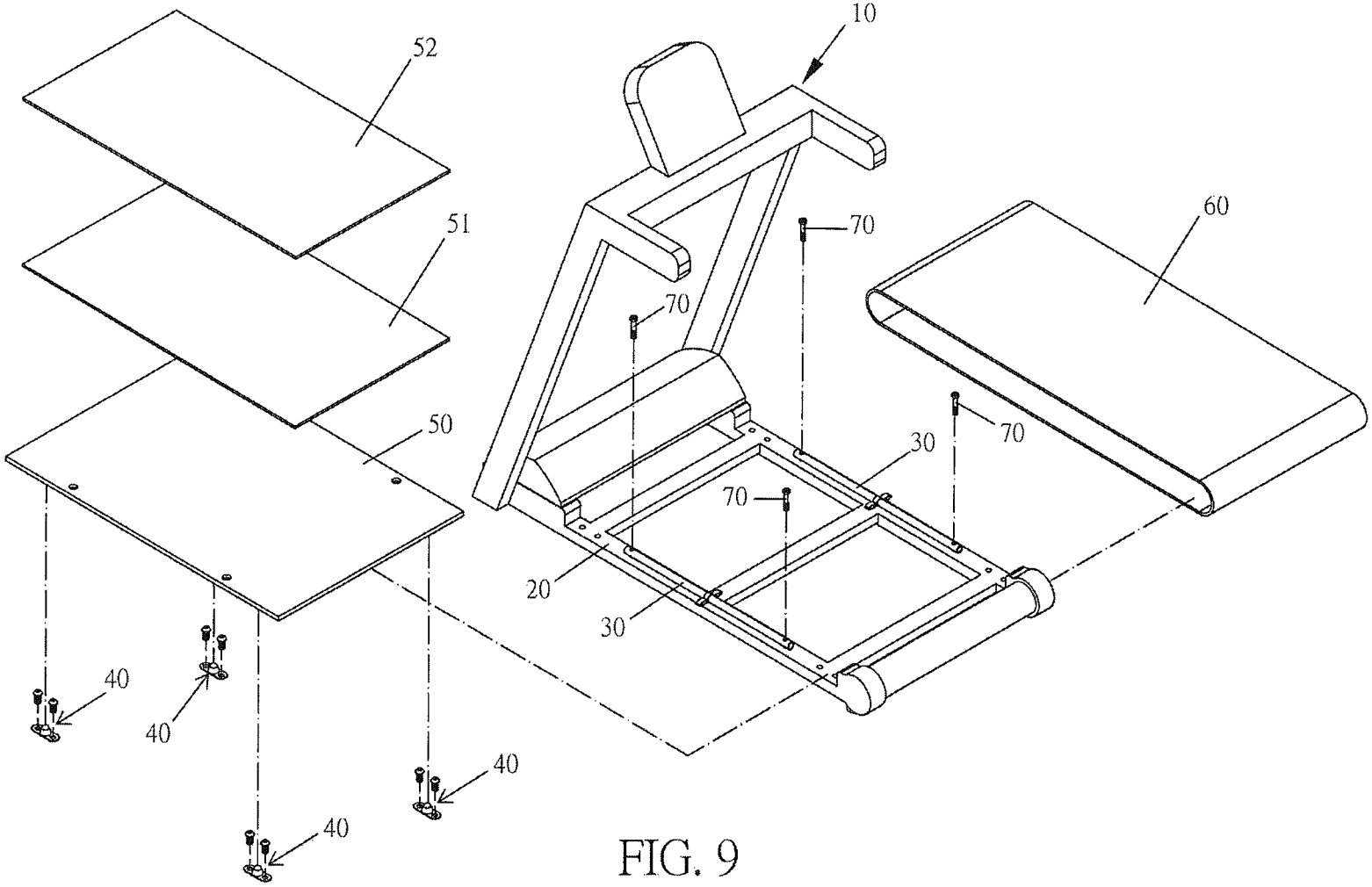
FIG. 9 is a partially exploded perspective view of the treadmill as shown in FIG. 1.
Figure 10:
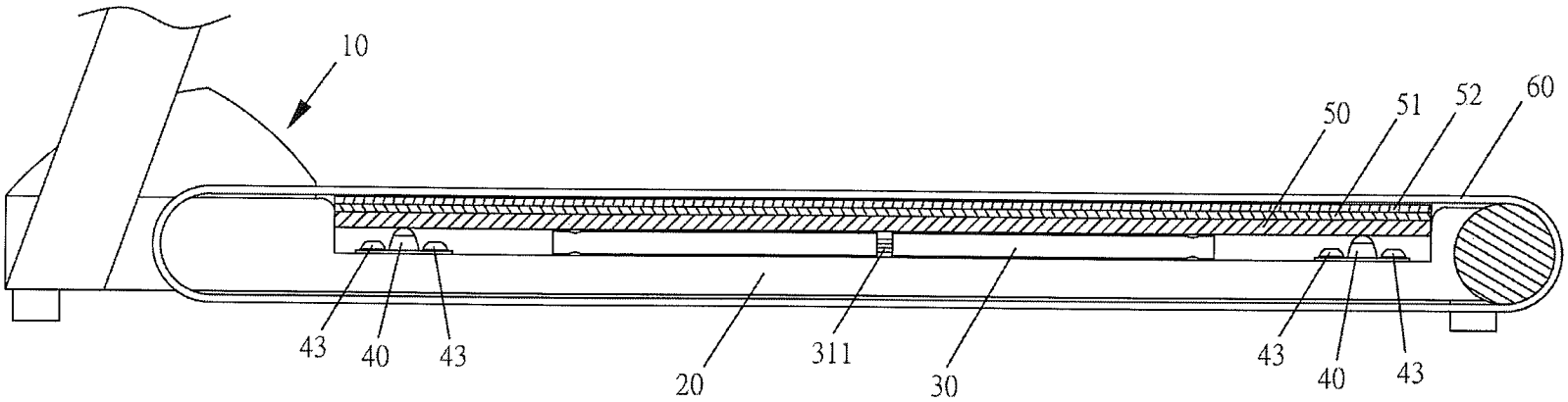
FIG. 10 is a cross-sectional view of the treadmill as shown in FIG. 1.
Figure 11:
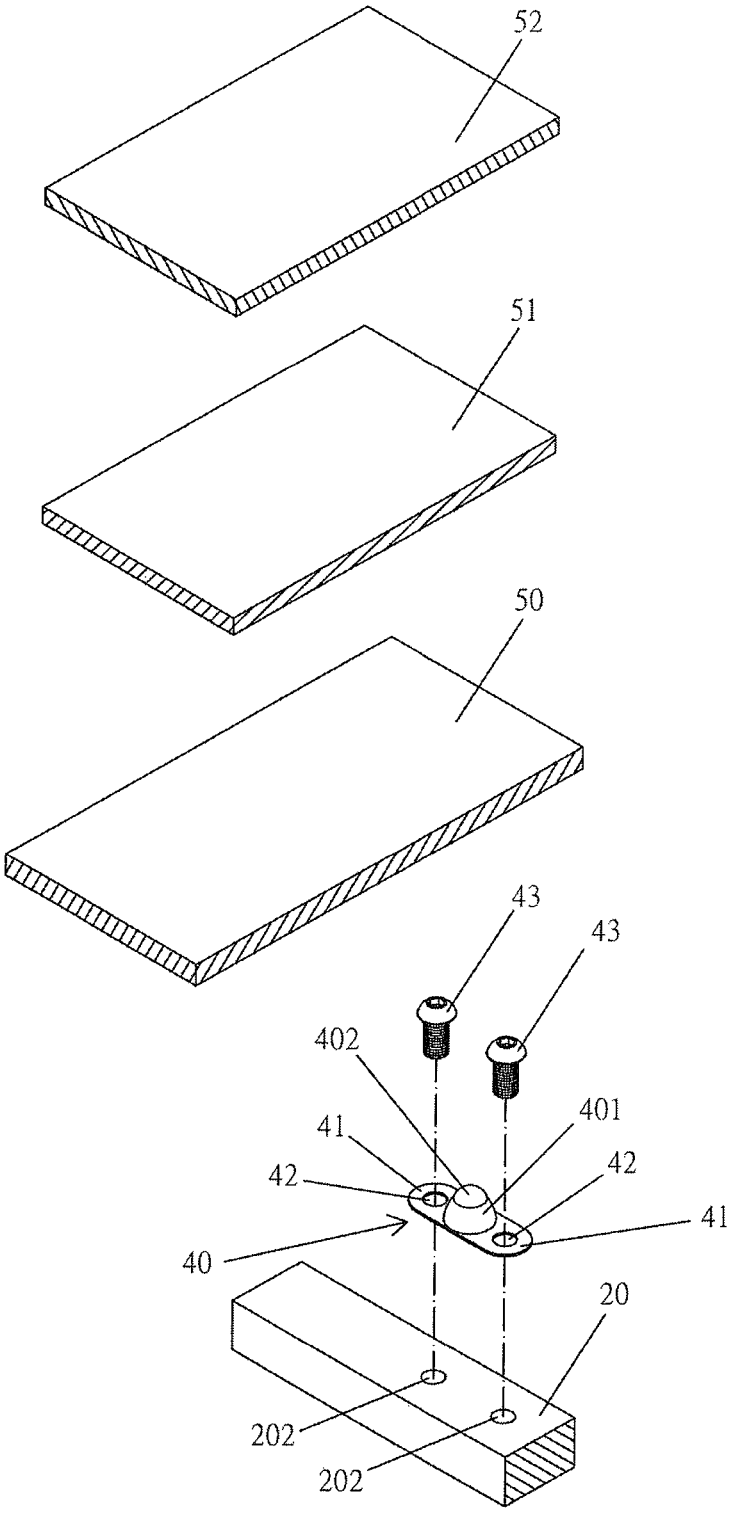
FIG. 11 is a locally enlarged perspective cross-sectional view of the treadmill as shown in FIG. 9.
Figure 12:
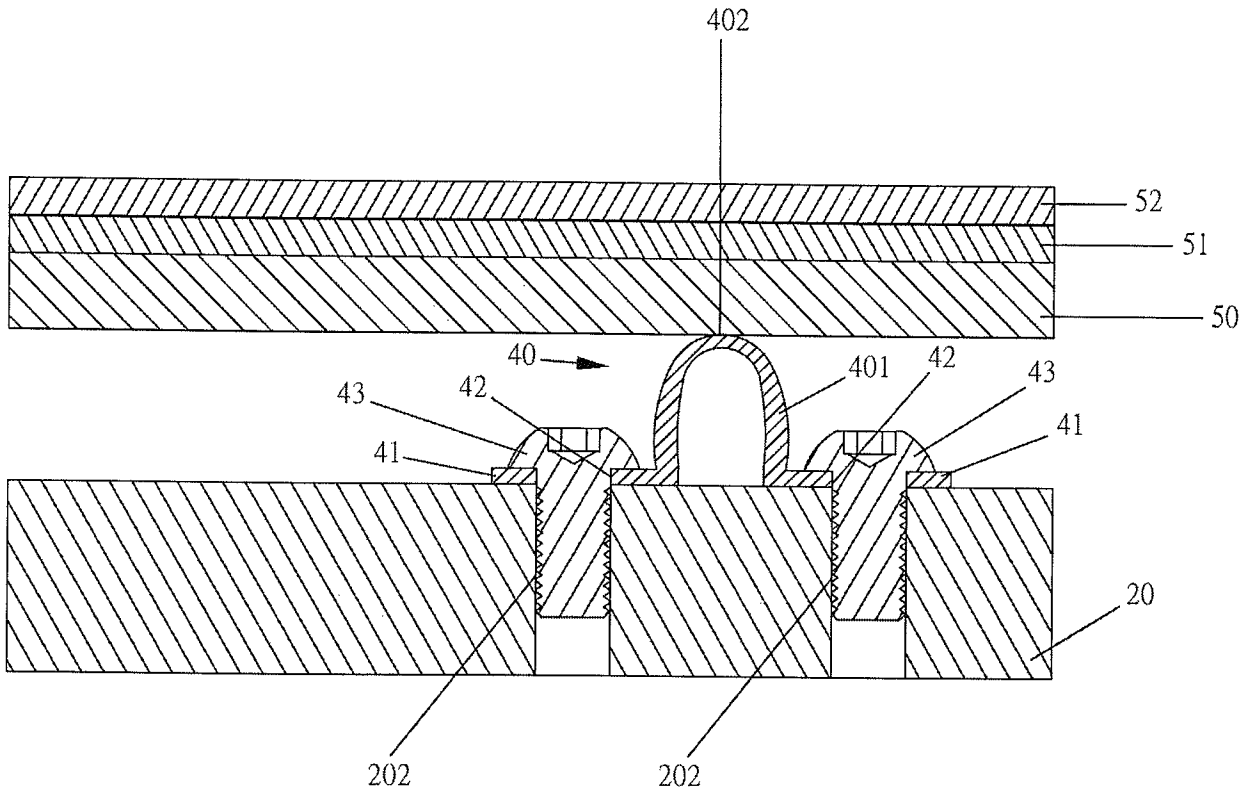
FIG. 12 is a cross-sectional assembly view of the treadmill as shown in FIG. 11.

On the contrary, when the other one of the two pull tabs 311 at the inner side of the mounting ring 31 is pulled, the elastic bar 30 of each of the shock-absorbing structures is pulled toward the inner side of one of the side frames 20 to increase the contact area of the elastic bar 30 and the support plate 50 and to move the elastic bar 30 from the position as shown in FIG. 6 to the position at the inner side of the support plate 50 as shown in FIG. 8. At this time, the elastic bar 30 of each of the shock-absorbing structures is slightly exposed outward from the inner side of one of the side frames 20. In such a manner, when the elastic bar 30 of each of the shock-absorbing structures is pulled toward the inner side of one of the side frames 20, the contact area of the elastic bar 30 and the support plate 50 is increased, so that the elastic bar 30 of each of the shock-absorbing structures provides a larger buffering force to the support plate 50 and is available for a user having a heavier weight. In addition, when the elastic bar 30 of each of the shock-absorbing structures is pulled toward the inner side of one of the side frames 20, the elastic bar 30 is located at the inner side of the support plate 50, so that the elastic bar 30 of each of the shock-absorbing structures applies a larger reaction to the support plate 50, and the central portion of the support plate 50 is disposed at a harder state due to the increased reaction of the elastic bar 30.

Referring to FIGS. 9-14, each of the shock-absorbing structures further includes a plurality of vibration absorbers 40 mounted between the support plate 50 and one of the side frames 20. The vibration absorbers 40 of the shock-absorbing structures are secured on two opposite ends of each of the side frames 20 to support the two opposite sides of the support plate 50. Each of the vibration absorbers 40 is a hollow block and has a top 402 and a bottom. Each of the vibration absorbers 40 has a side wall 401 whose cross-sectional thickness is gradually increased from the top 402 to the bottom of each of the vibration absorbers 40 and whose peripheral width is gradually increased from the top 402 to the bottom of each of the vibration absorbers 40. Each of the vibration absorbers 40 is provided with two side wings 41 each having an aperture 42, each of the side frames 20 is provided with a plurality of screw bores 202, and each of the shock-absorbing structures further includes a plurality of bolts 43 extending through the apertures 42 of the side wings 41 of the vibration absorbers 40 and screwed into the screw bores 202 of the side frames 20.

Figure 13:
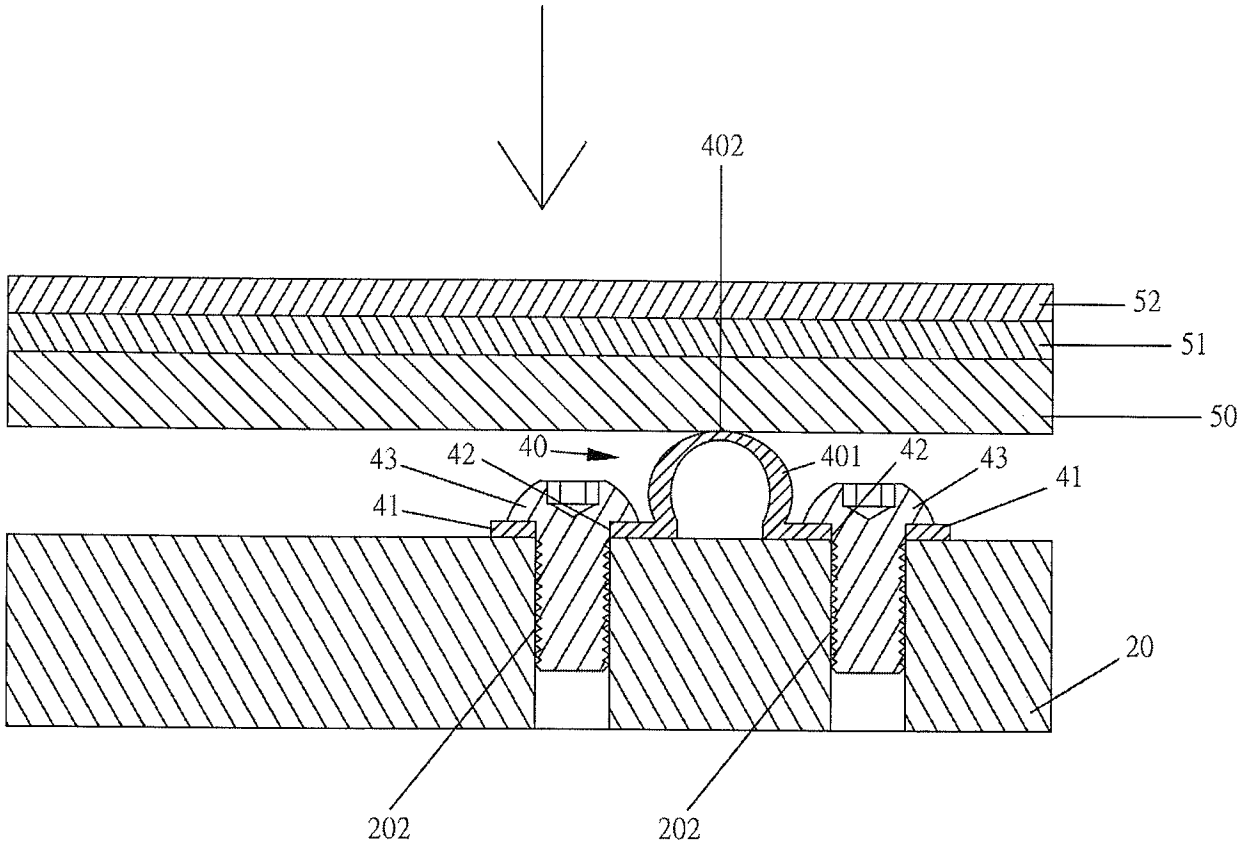
FIG. 13 is a schematic operational view of the treadmill as shown in FIG. 12, wherein when the support plate is subjected to a larger downward force.
Figure 14:
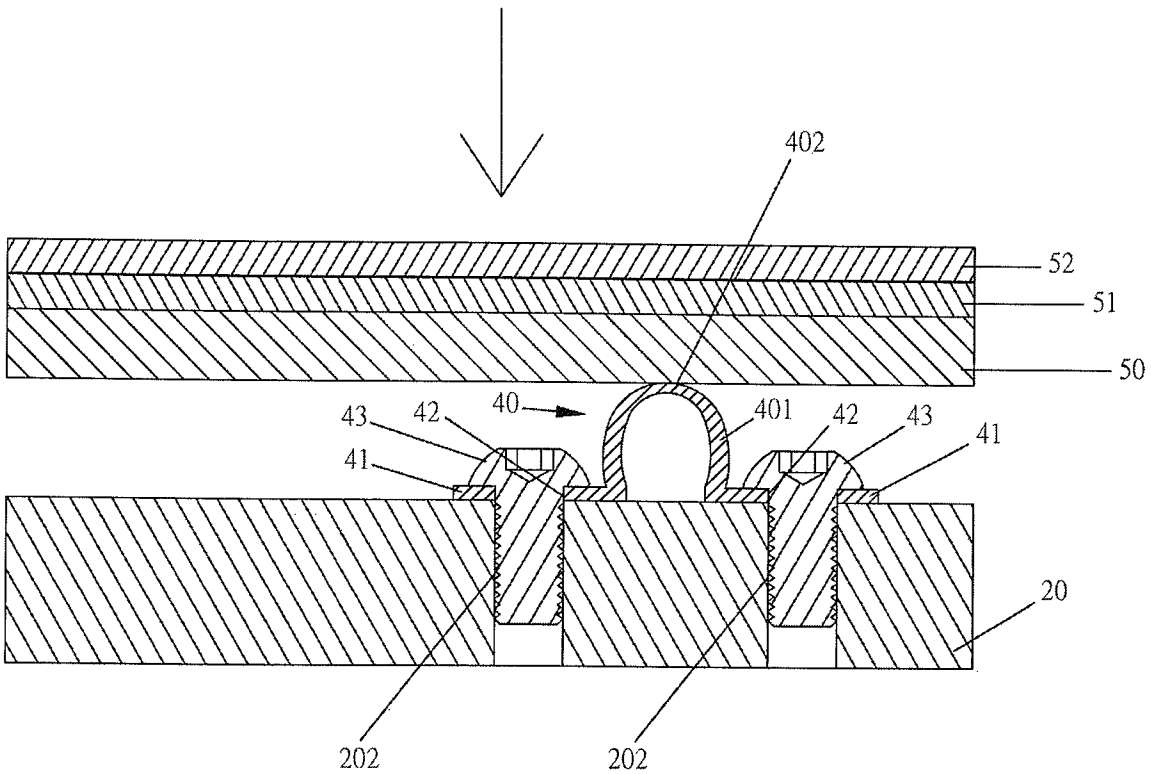
FIG. 14 is a schematic operational view of the treadmill as shown in FIG. 12, wherein when the support plate is subjected to a smaller downward force.

In operation, referring to FIGS. 13 and 14 with reference to FIGS. 9-12, when the user steps on the belt 60 of the treadmill 10, the support plate 50 is subjected to a downward force as shown in FIGS. 13 and 14 to press the vibration absorbers 40. At this time, the side wall 401 of each of the vibration absorbers 40 resiliently expands outward evenly so that the vibration absorbers 40 provide a vibration damping function to the support plate 50 to provide a comfortable sensation to the user.

As shown in FIG. 13, when the support plate 50 is subjected to a larger downward force, each of the vibration absorbers 40 is compressed to have a relatively larger elastic strain (the thicker lower portion of the side wall 401 is compressed) so as to provide a larger damping effect to the support plate 50.

As shown in FIG. 14, when the support plate 50 is subjected to a smaller downward force, each of the vibration absorbers 40 is compressed to have a relatively smaller elastic strain (only the top 402 and the thinner upper portion of the side wall 401 are compressed) so as to provide a smaller damping effect to the support plate 50.

Accordingly, the contact area of the elastic bar 30 and the support plate 50 can be changed freely according to the requirement of users having different weights so as to adjust the reaction applied by the elastic bar 30 on the support plate 50, and to adjust the shock-absorbing function of the elastic bar 30. In addition, when the elastic bar 30 is located at the outer side of the support plate 50, the central portion of the support plate 50 is disposed at a softer state, and when the elastic bar 30 is located at the inner side of the support plate 50, the central portion of the support plate 50 is disposed at a harder state, so that the buffering function of the elastic bar 30 on the support plate 50 can be changed according to the user's requirement. Further, the elastic bar 30 is mounted between one of the side frames 20 and the support plate 50 and is disposed at an exposed state so that the user can easily pull the pull tabs 311 at two opposite sides of the mounting ring 31 so as to change the contact area of the elastic bar 30 and the support plate 50 quickly and conveniently. Further, the two opposite ends of the elastic bar 30 are pivotally mounted between one of the side frames 20 and the support plate 50, and the fixing sleeves 32 are respectively mounted in the two opposite ends of the elastic bar 30 to reinforce the structural strength of the elastic bar 30, thereby preventing the two opposite ends of the elastic bar 30 from being worn or torn due to frequently and repeatedly pulling actions during a long-term utilization. Further, each of the vibration absorbers 40 has a side wall 401 whose cross-sectional thickness is gradually increased downward and whose peripheral width is gradually increased downward, while each of the vibration absorbers 40 has a top 402 with a closed state, so that when the vibration absorbers 40 are compressed by the support plate 50, the vibration absorbers 40 can evenly and smoothly withstand and distribute the force applied by the support plate 50, such that the vibration absorbers 40 are not easily worn out or broken during a long-term utilization, thereby enhancing the lifetime of the vibration absorbers 40. Further, each of the vibration absorbers 40 can adjust its elastic strain according to the force applied by the support plate 50 so as to reach the optimum shock-absorbing and vibration damping effect. Further, the styrofoam layer 51 has a lower price and provides buffering function to the support plate 50. Further, the surface layer 52 isolates the styrofoam layer 51 from the belt 60 to prevent the styrofoam layer 51 from directly contacting the belt 60 to enhance the lifetime of the styrofoam layer 51. Further, the surface layer 52 is made of PVC material having a wear-resistant feature to enhance the lifetime of the support plate 50. Further, the elastic bar 30, the vibration absorbers 40 and the styrofoam layer 51 provide multiple shock-absorbing and vibration damping functions to the support plate 50 so that the treadmill 10 provides a comfortable sensation to the user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A treadmill comprising:
two side frames;
a support plate disposed above the two side frames;
two shock-absorbing structures mounted between the support plate and the two side frames;
a polystyrene layer mounted on the support plate; and
a surface layer mounted on the polystyrene layer, wherein:
each of the two shock-absorbing structures includes an elastic bar mounted between the support plate and one of the two side frames;
the elastic bar is movable in a transverse direction and is elastically bendable toward two opposite sides of one of the two side frames;
each of the two shock-absorbing structures further includes a mounting ring mounted on the elastic bar;
the mounting ring is provided with two pull tabs; and
the two pull tabs are located at two opposite sides of the mounting ring and are directed toward two opposite directions.

2. The treadmill of claim 1, wherein the elastic bar is a hollow tube and has two opposite ends each pivotally mounted between the support plate and one of the side frames.

3. The treadmill of claim 1, wherein the elastic bar is made of rubber.

4. The treadmill of claim 1, wherein:
each of the two shock-absorbing structures further two fixing sleeves mounted in the elastic bar; and
the two fixing sleeves are respectively mounted in the two opposite ends of the elastic bar and are pivotally mounted on one of the two side frames.

5. The treadmill of claim 1, wherein:
each of the shock-absorbing structures further includes a plurality of vibration absorbers mounted between the support plate and one of the two side frames;
each of the plurality of vibration absorbers is a hollow block and has a top and a bottom; and
each of the plurality of vibration absorbers has a side wall whose cross-sectional thickness is gradually increased from the top to the bottom of each of the plurality of vibration absorbers and whose peripheral width is gradually increased from the top to the bottom of each of the plurality of vibration absorbers.

6. The treadmill of claim 5, wherein:
the elastic bars of the two shock-absorbing structures support the two opposite sides of the support plate;
the elastic bar is arranged on a mediate section of one of the two side frames; and
the plurality of vibration absorbers of the two shock-absorbing structures are secured on two opposite ends of each of the two side frames.

7. The treadmill of claim 1, wherein the surface layer is made of PVC material.

8. A treadmill comprising:
two side frames;
a support plate disposed above the two side frames;
two shock-absorbing structures mounted between the support plate and the two side frames;
a polystyrene layer mounted on the support plate; and
a surface layer mounted on the polystyrene layer, wherein:
each of the two shock-absorbing structures includes an elastic bar mounted between the support plate and one of the two side frames;
the elastic bar is movable in a transverse direction and is elastically bendable toward two opposite sides of one of the two side frames;
each of the two shock-absorbing structures further two fixing sleeves mounted in the elastic bar;
the two fixing sleeves are respectively mounted in the two opposite ends of the elastic bar and are pivotally mounted on one of the two side frames; and
the support plate has two opposite sides each provided with two first through holes, each of the two opposite ends of the elastic bar is provided with a second through hole, each of the fixing sleeves is provided with a third through hole, each of the two side frames is provided with two fourth through holes, and each of the two shock-absorbing structures further includes two pivot members each extending through the respective first through hole of the support plate, the respective second through hole of the elastic bar, the third through hole of the respective fixing sleeve and the respective fourth through hole of one of the two side frames, so that each of the two opposite ends of the elastic bar is pivotally mounted between the support plate and one of the two side frames.

9. A treadmill comprising:
two side frames;
a support plate disposed above the two side frames;

two shock-absorbing structures mounted between the support plate and the two side frames;

a polystyrene layer mounted on the support plate; and a surface layer mounted on the polystyrene layer, wherein:

each of the two shock-absorbing structures includes an elastic bar mounted between the support plate and one of the two side frames;

the elastic bar is movable in a transverse direction and is elastically bendable toward two opposite sides of one of the two side frames;

each of the shock-absorbing structures further includes a plurality of vibration absorbers mounted between the support plate and one of the two side frames;

each of the plurality of vibration absorbers is a hollow block and has a top and a bottom;

each of the plurality of vibration absorbers has a side wall whose cross-sectional thickness is gradually increased from the top to the bottom of each of the plurality of vibration absorbers and whose peripheral width is gradually increased from the top to the bottom of each of the plurality of vibration absorbers; and each of the plurality of vibration absorbers is provided with two side wings each having an aperture, each of the two side frames is provided with a plurality of screw bores, and each of the two shock-absorbing structures further includes a plurality of bolts extending through the apertures of the two side wings of the plurality of vibration absorbers and screwed into the plurality of screw bores of the two side frames.

* * * * *